US007770948B2

(12) United States Patent
Ellis

(10) Patent No.: US 7,770,948 B2
(45) **Date of Patent: *Aug. 10, 2010**

(54) TUBULAR LOCK LATCH ASSEMBLY

(75) Inventor: Philip C. Ellis, Sinking Spring, PA (US)

(73) Assignee: Newfrey, LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/899,334

(22) Filed: Sep. 5, 2007

(65) Prior Publication Data

US 2008/0079267 A1 Apr. 3, 2008

Related U.S. Application Data

(63) Continuation of application No. 11/542,358, filed on Oct. 3, 2006.

(51) Int. Cl.
*E05B 9/00* (2006.01)

(52) U.S. Cl. ..... 292/337; 292/1.5

(58) Field of Classification Search ..... 292/337, 292/165, 169, 1.5, 336.3; 70/472, 244, 208, 70/210

See application file for complete search history.

(56) References Cited

U.S. PATENT DOCUMENTS 2,401,559 A * 6/1946 Falk ..... 292/165
2,483,368 A * 9/1949 Ledin ..... 292/165
5,513,510 A 5/1996 Solovieff et al.
5,624,141 A * 4/1997 Kuo et al. ..... 292/165
5,647,617 A * 7/1997 Kajuch ..... 292/1.5
6,419,288 B1 * 7/2002 Wheatland ..... 292/337
2005/0057051 A1 * 3/2005 Bartos ..... 292/337

* cited by examiner

*Primary Examiner*—Peter M Cuomo
*Assistant Examiner*—Kristina R Fulton
(74) *Attorney, Agent, or Firm*—Ober / Kaler; Royal W. Craig

(57) ABSTRACT

A tubular latch assembly for a door and adapted for operation by either an "opener" such as a thumbpiece on one side and/or a knob on the other. The tubular latch comprises a central latch subassembly mounted inside the door and including a latch casing seated in the door, a bolt slidably mounted in said latch casing for extension/retraction (such as through an open face plate), a pivoting retraction lever coupled to the bolt, a spindle hub having a pair of offset cam surfaces, and a pivoting reversing lever engaged at one end with the bolt and at the other end with the second cam surface on the spindle hub for driving the bolt. The central latch subassembly allows opening by either the opener (e.g., thumbpiece) or by rotation of the knob, operation of the knob not affecting the opener and vice versa. This entirely eliminates any need for off-axis motion translation or accompanying mechanisms that are ordinarily used to adapt the axis of rotation of an opener to the orthogonal axis of rotation of a latch or spindle hub, thereby reducing the total number of parts as well as internal friction.

12 Claims, 11 Drawing Sheets

TUBULAR LOCK LATCH ASSEMBLY

CROSS-REFERENCE TO RELATED APPLICATIONS

The present application is a continuation of U.S. application Ser. No. 11/542,358, filed 3 Oct. 2006.

BACKGROUND OF THE INVENTION

1. Field of the Invention

The present invention relates to door locks and, more particularly, to a tubular latch assembly for use with handlesets or the like that is operable by movement of an opener such as a thumbpiece or the like.

2. Background of the Invention

Main entry doors on commercial and residential buildings are often equipped with exterior "handlesets", which consist of a handle or "pull" mounted on an escutcheon plate and a thumbpiece for operating the lock mechanism mounted above the handle, in such a way that the thumbpiece can be operated with the thumb while grasping the handle. Although a number of different lock mechanisms may be equipped with handlesets, the types known as tubular, or "bored through" locksets have become virtually universal in residential applications. Tubular handlesets are designed to be installed in an industry standard pattern of holes drilled in the edge and face of the door. Compared to traditional door preparation methods, such as cutting mortise pocket in the door edge, drilled door preps require substantially less time and skill. Unfortunately, they also impose constraints on the space available for the operating mechanism of the lock, and consequently make the mechanical design of the mechanism more difficult.

Latches are usually designed so that the latch bolt is retracted by the action of a slide bar that interacts with cams projecting from a hub or pair of hubs that rotate on an axis perpendicular to the direction of movement of the latch bolt. Other arrangements exist, but all work according to the same basic principle. The hubs are typically activated by a spindle attached to a knob or lever on the inside of the door, with an axis of rotation that is aligned with the axis of rotation of the latch hubs. When the latch is actuated by a handleset, however, the motion of the thumbpiece is essentially a vertical motion that acts perpendicular to the plane formed by the line of movement of the bolt and the axis of rotation of the hubs. A motion translator is therefore required to change the movement of the thumbpiece into a rotational motion that can be used to drive the latch hubs. So typically, the latch of a tubular handleset is operated by a spindle connected to a knob or lever on the inside and a spindle attached to a motion translator driven by the thumbpiece from the outside. In most cases, the latch has two hubs, one operated by each spindle, so that the inside and outside trims operate independently.

Another design issue in tubular handlesets is that, while it is desirable for a knob or lever to have 45 degrees or less rotation to assure a comfortable range of hand motion, reducing the hub rotation imposes unacceptably high load requirements at the thumbpiece, which is smaller than the knob or lever, making it more difficult to apply a force necessary to operate the latch. This is especially true in situations where there is a warped door or tight weather stripping. In addition to affecting the effort required to operate the thumbpiece, forces experienced by the components of the motion translator are high, increasing internal friction and making the components more likely to break. The problem may be overcome by making the range of movement of the thumbpiece very large, but that is undesirable for both mechanical and ergonomic reasons.

Another effect of using a motion translator between the thumbpiece and the latch is an increase in the number of components in the lockset. For example, FIG. 22 is a prior art illustration from U.S. Pat. No. 5,513,510 to Solovieff et al. showing an exemplary handleset with thumbpiece and rack that requires a motion translation mechanism, and particularly gear pieces 52, 56 to change the vertical motion of the thumbpiece 10 to the rotary motion of the latch hub 66. Referring to FIG. 22, it can be seen that item 32, 33, 52 and 58 are required only for translation of the motion of thumbpiece 10 to rotation to operate latch 80. These components add cost, both in the cost of the component itself and added assembly cost of the mechanism. They also increase internal friction through contact between the parts and in the bearings and surfaces required to guide them, and decrease reliability as the parts are small and are difficult to manufacture and assemble correctly.

It would be greatly advantageous to provide a latch that allows for direct actuation by a thumbpiece (or other opener) without an intervening motion translation mechanism. It would also be desirable to have such a latch that could also be independently actuated by a spindle attached to a knob or lever, and which could be operated in either direction to accommodate use with knobs or, in the case of levers, both left hand and right hand operation.

SUMMARY OF THE INVENTION

It is, therefore, the primary object of the present invention to provide for direct operation of a tubular latch by an opener (e.g., thumbpiece, or the like), eliminating any need for off-axis motion translation or accompanying mechanisms that are ordinarily used to adapt the axis of rotation of the opener (e.g., thumbpiece or the like) to the axis of rotation of a latch hub.

It is another object to reduce the total number of parts and internal friction normally associated with prior art tubular latches requiring a motion translator for an off-axis thumbpiece, thereby providing smoother operation, reduced cost and improved reliability.

It is still another object to provide a tubular latch that can be directly operated by a thumbpiece or the like on one or both sides of the door, and also can be independently operated by a spindle driven by a knob or lever on the inside, where operation by knob or lever does not affect the thumbpiece, and vice-versa.

It is still another object to provide a tubular latch with a less-than-45-degree range of knob (or spindle) rotation without adversely affecting the amount of motion or force required to operate the thumbpiece, effectively making the thumbpiece operation independent of the latch hub.

In accordance with the foregoing objects, the present invention is a latch that allows opening by a handleset thumbpiece from outside the door, and any of a handleset thumbpiece or lever, or alternately a knob from inside the door, the motion of the two not affecting one another.

The tubular latch generally comprises a central latch subassembly mounted inside the door and including a latch casing secured inside the door (and opening through edgewise to the door), a bolt slidably mounted in said latch casing for extension/retraction, a pivoting retraction lever coupled to the bolt for camming the bolt. The retraction lever can be pivoted from either side of the door to open the bolt using opposing handleset thumbpieces on both sides of the door (a "back-to-back" mount) or, alternatively, by a handleset thumpiece on one side and a rotary knob or lever on the other side. In the latter case, a spindle hub is rotatably mounted in the latch casing, the spindle hub having a cam surface for engaging the retraction lever. This allows opening by either the thumbpiece or by rotation of the knob, operation of the knob not affecting the thumbpiece and vice versa.

The central latch subassembly may be adapted for bi-directional operation of the spindle hub, depending on the application, by inclusion of a second cam surface on the spindle hub and a pivoting reversing lever engaged at one end with the bolt or with the retracting lever and at the other end with the second cam surface on the spindle hub.

The foregoing latch subassembly entirely eliminates any need for off-axis motion translation or accompanying mechanisms that are ordinarily used to adapt the axis of rotation of a thumbpiece to the orthogonal axis of rotation of a latch or spindle hub, thereby reducing the total number of parts as well as the internal friction normally associated with the motion translator.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is a tubular latch that allows for retraction of the latch by direct action of a thumbpiece (or any other "operator"), without any intermediate off-axis motion translation mechanisms, or by operation of a knob or lever turning a spindle hub within the latch. The latch according to the present invention is herein described in the context of a typical handleset including exterior escutcheon, handle and thumbpiece, though other configurations are readily possible in which a bolt is slidably moved along an axis alternately by some form of opener (including knob or lever) turning along a perpendicular axis of rotation and/or by another form of operator (such as a pivoting thumbpiece) pivoting about an axis parallel to that of the bolt movement, without any intermediate off-axis motion translation mechanisms.

Figure 1A:
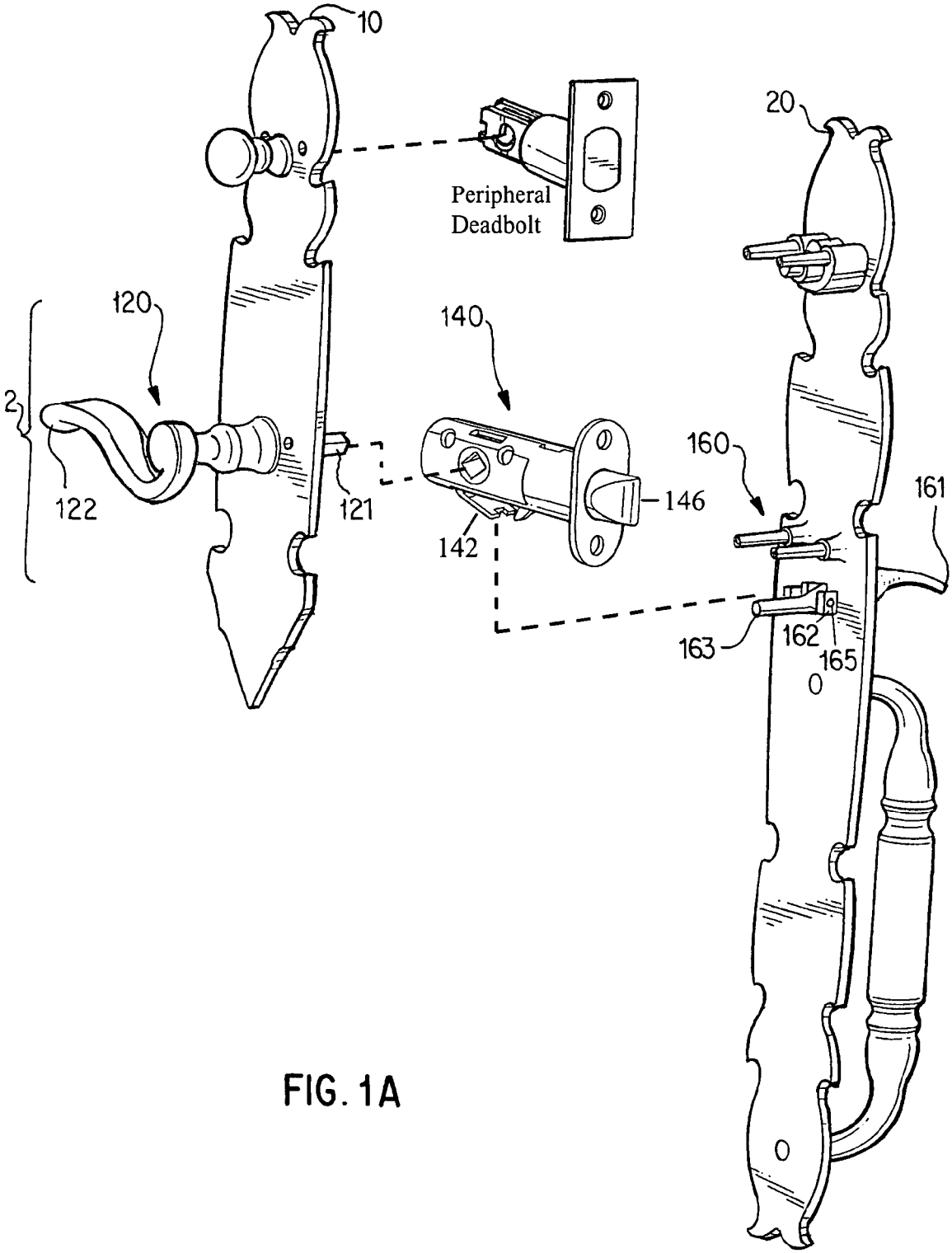
FIG. 1(A) is a composite exploded view of a handleset 2 as installed between an inside escutcheon 10 and outside escutcheon 20 of a door.

FIG. 1(A) is a composite exploded view of the central latch subassembly 140, installed between the inside subassembly 120 and the outside subassembly 160 of handleset 2. A peripheral deadbolt at top is not a part of the present invention. Subassembly 120 is for opening/closing the door from inside, outside subassembly 160 including thumbpiece 161 is for opening/closing the door from outside.

The thumbpiece 161 pivots on a yoke 162 about a pivot axis, the yoke 162 being secured to the outside escutcheon 20. The rear of the thumbpiece 161 wields an extension 163 that enters the escutcheon 20, and is secured by a pivot pin 165, thus downward movement of 161 by thumb results in an upward movement of extension 163. As the extension 163 rocks upward it bears against the bottom of a retraction lever 142 (see below) attached as part of central latch subassembly 140 and pushes it upward when the thumbpiece 161 is depressed, in turn retracting the bolt 146.

Figure 1B:
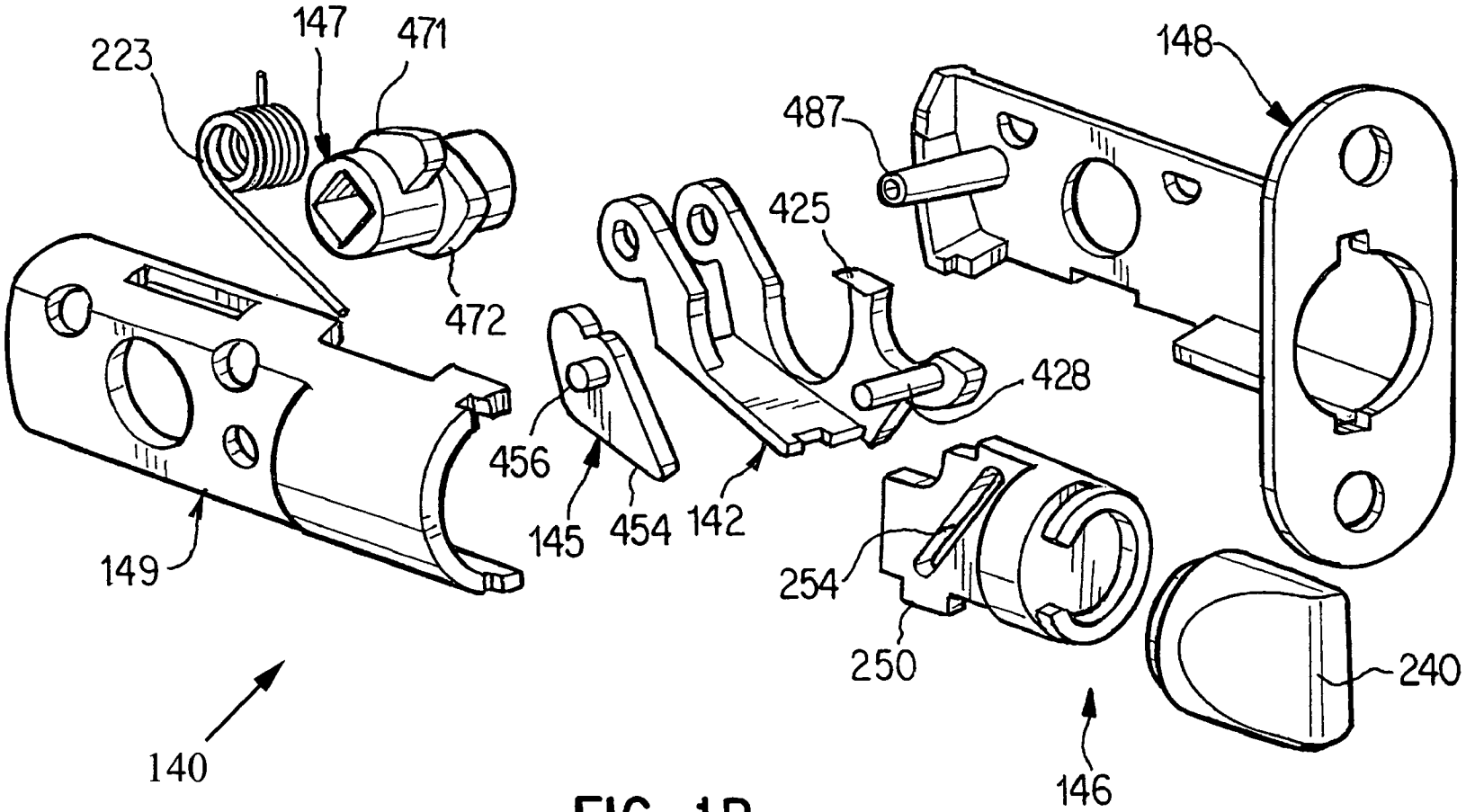
FIG. 1(B) is an enlarged exploded illustration of the central latch subassembly 140 as in FIG. 1(A).

FIG. 1(B) is an enlarged exploded illustration of the central latch subassembly 140 as in FIG. 1(A), inclusive of the retraction lever 142. When the retraction lever 142 moves upward, a lateral pin 428 at its forward end slides upward along a ramped rearward surface of aperture 254 formed in the tail 250 of bolt 146, thereby camming the bolt 146 backward along a linear axis of movement so that it retracts into the case formed by halves 148, 149, and allowing the door to open. The retraction lever 142 is pivoted on a screw stem 487 that lies in the case 148, 149.

In a simple form of the present invention this retraction lever 142 is all that is needed to cam the bolt 146. An identical thumbpiece 161, extension 163 and escutcheon 20 can be mounted on the inside of the door (thereby giving a "back-to-back" mount of opposing handlesets/thumbpieces, wherein the retraction lever 142 may be pivoted from both sides by direct actuation of the respective thumbpieces. However, the embodiment as shown in FIGS. 1(A&B) and further described herein uses a rotary knob 122 or lever attached to the inside escutcheon 10, and a rotary knob 122 rotates a spindle hub 147 about an axis of rotation, and the spindle hub 147 engages the retraction lever 142. The spindle hub 147 is disposed for pivoting about a pivot axis that is parallel to that of the retraction lever, and perpendicular to the linear axis of movement of said bolt. A torsion spring 223 is loaded onto the screw stem 487 between the pivot arms of the retraction lever 142 to bias it down to its home position. In the current embodiment, the aperture is in the form of a groove with a ramped forward surface which is acted on by lateral pin 428 to extend the bolt as retracting lever returns to its home position. The aperture could just as well be constructed in such a way that only the rearward surface is ramped to engage pin 487. In such a construction, the bolt would be retracted by action of pin 487 against the ramp, but would be equipped with independent springs to return it to the extended position when retracting lever 142 returned to its home position.

The spindle hub 147 is rotatably seated across the halves 148, 149 of the latch case, and hub 147 is broached to accept a spindle 121 protruding inward from the knob 122 or lever that is attached to the inside escutcheon 10. The spindle hub 147 is defined by two forward cam surfaces 471, 472 which are axially offset from each other. When the spindle hub 147 is rotated counterclockwise, the inner cam surface 472 (closest to the retraction lever 142) will bear upward against a lateral lug formed in a lifter arm 425 at the forefront of retraction lever 142, thereby lifting retraction lever 142 and retracting the bolt 146. Conversely, when the spindle hub 147 is operated clockwise the outer cam surface 471 engages one end of a pivoting reversing lever 145. The reversing lever 145 extends to a lift arm 454 that engages the lateral pin 428 of the retraction lever 142 (see also FIGS. 8 and 9), thereby lifting the retraction lever 142, and in turn camming the bolt 146 back so that it retracts into the case formed by halves 148, 149, thereby allowing the door to open. The thumbpiece 161 is not affected. Note also that when the retraction lever 142 is fully retracted, it remains flush with the bottom of the latch case 148, 149 to allow the latch to be installed in the edge bore of the door.

Figure 2:
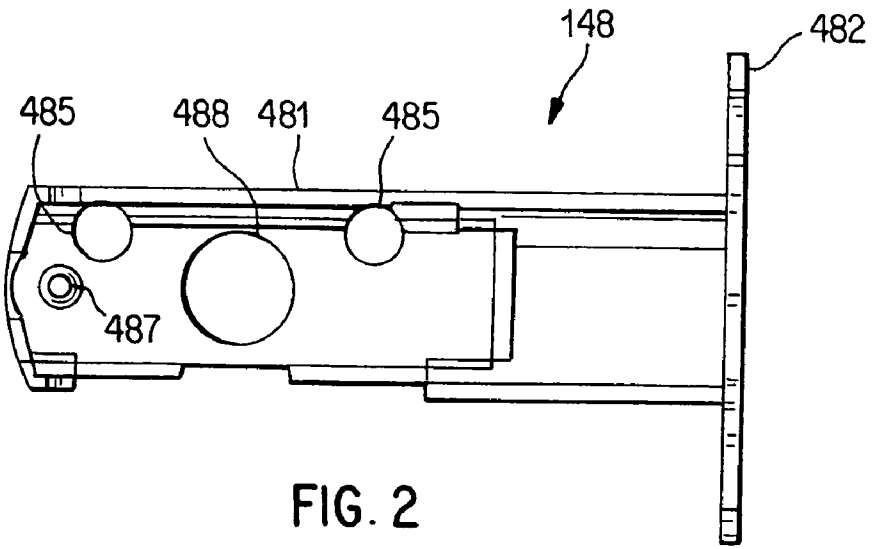
FIGS. 2-4 are an inside view, top view and front end view, respectively, of the right side casing half 149 of FIG. 1B.
Figure 3:
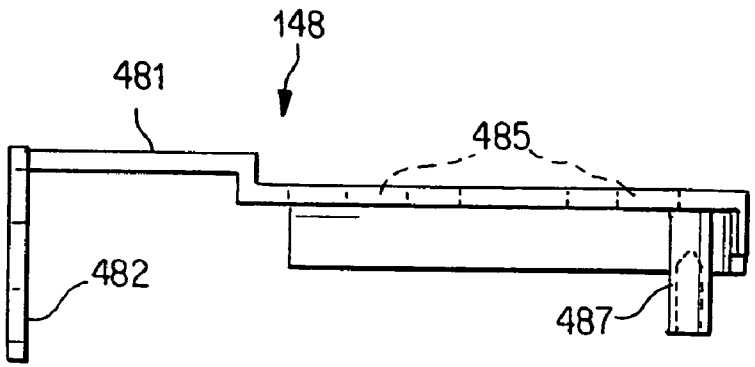
Figure 4:
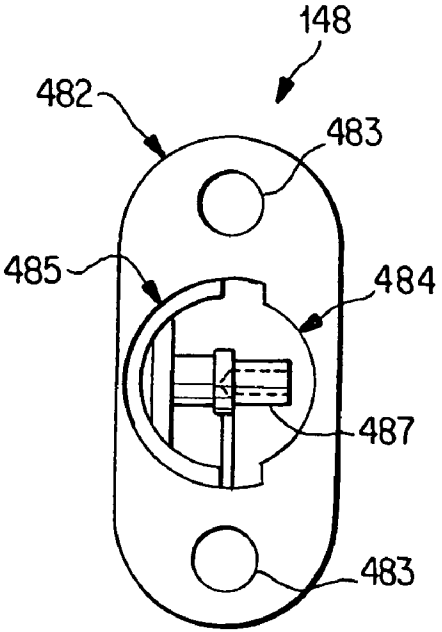

FIGS. 2-4 are an inside view, top view and front end view, respectively, of the right side casing half 148 of FIGS. 1(A&B). The right side casing 148 generally comprises a unitary member having an oblong face plate 482 defined by a central bolt aperture 484 flanked on top and bottom by opposing securement holes 483 for screw-attachment to a doorjamb. The face plate 482 is integrally joined to a rearwardly protruding casing wall 481 which serves as a half-enclosure for the internal components. Casing wall 481 is further defined by a spindle aperture 488 flanked by opposing securement holes 485 (these securement holes 485 receiving stems formed on the outside escutcheon for mounting), and an inwardly protruding screw stem 487 for securement to the left side casing half 149. When mounted as shown in FIG. 1(A), the retraction lever 142 pivots on screw stem 487.

Figure 5:
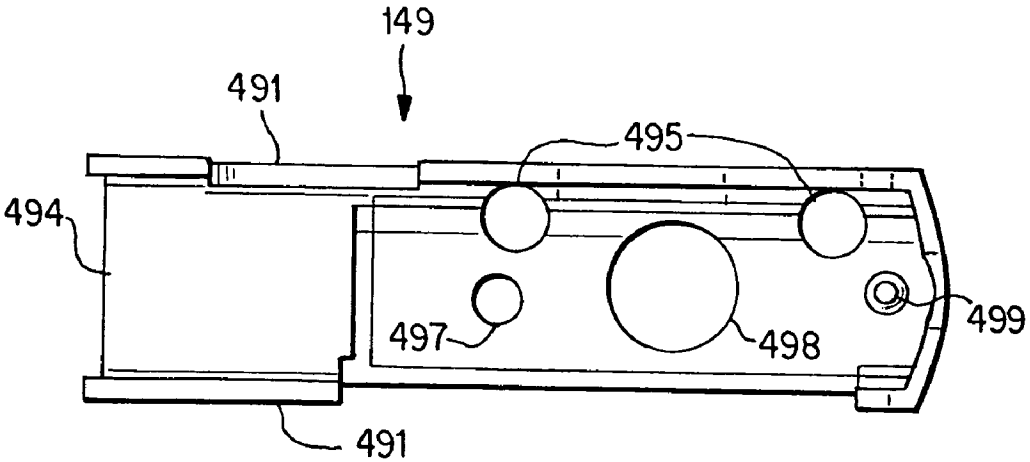
FIGS. 5-7 are an inside view, top view and front end view, respectively, of the left side casing half 148 of FIG. 1B.
Figure 6:
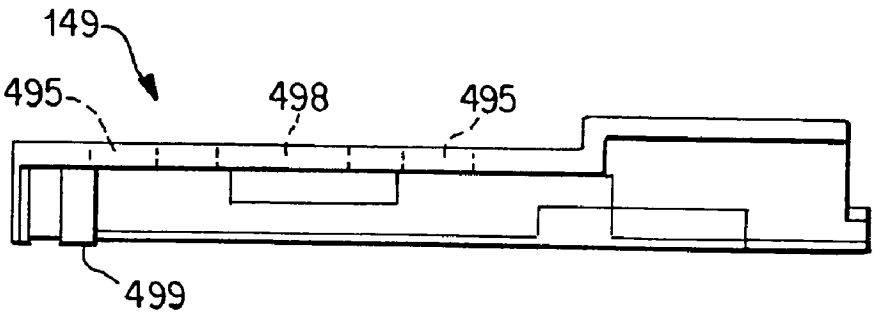
Figure 7:
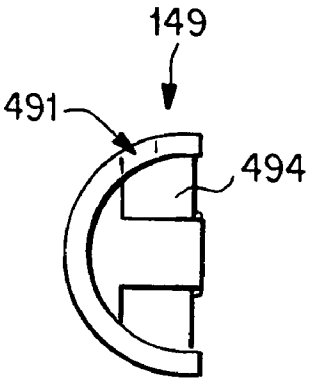

FIGS. 5-7 are an inside view, top view and front end view, respectively, of the left side casing half 149 of FIG. 1(B). The left side casing 149 generally comprises a unitary semi-cylindrical wall 491 defined by a bolt aperture 494 at one end. The casing wall 491 likewise serves as a mating half-enclosure (with right casing 148) for the internal components. Casing wall 491 is further defined by a spindle aperture 498 flanked by opposing securement holes 495, and a pivot hole 497 for mounting the reversing lever 145. As is apparent, the left and right side casings 148, 149 come together and are secured by a screw in screw stem 499 (which also passes through screw stem 487 in the right side casing 148) to enclose the internal components to be described. When mounted as shown in FIG. 1(A), the reversing lever 145 pivots on pin 456 (see FIG. 1B) inserted in pivot hole 497.

Figure 8:
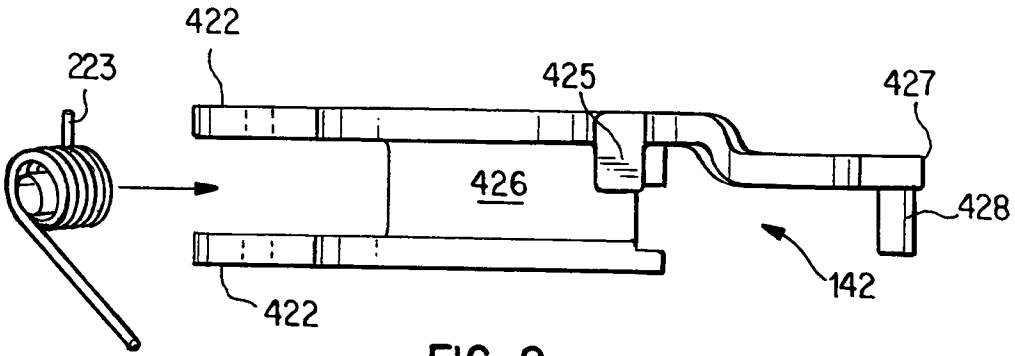
FIGS. 8-10 are a top view, side view and end view, respectively, of the retraction lever 142 of FIG. 1B.
Figure 10:
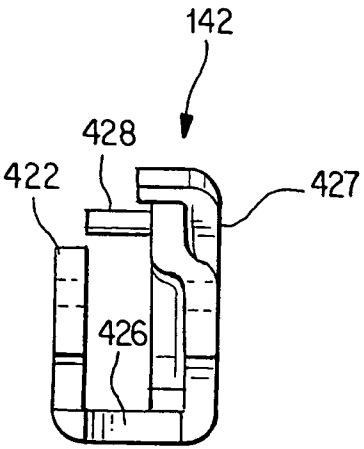
Figure 9:
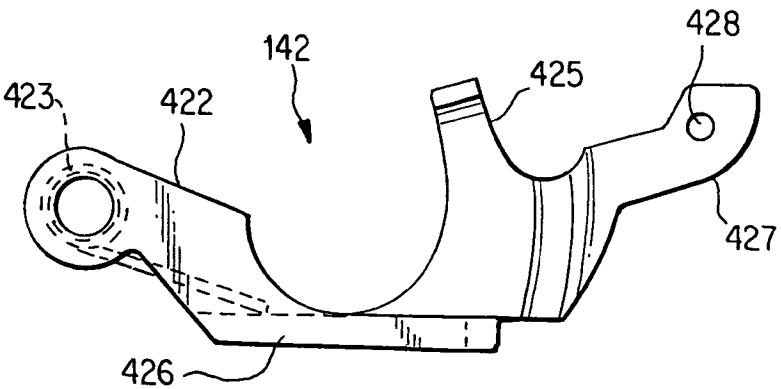

FIGS. 8-10 are a top view, side view and end view, respectively, of the retraction lever 142 of FIG. 1B.

As best seen in FIG. 9, retraction lever 142 may be formed as a unitary member with five primary sections including a parallel pair of upwardly raised pivot arms 422, each wielding a collar 423, a flat central section 426 for abutting the thumbpiece extension 163, an upwardly turned lifter arm 425 with furled over lug at the distal tip to provide a bearing surface for cam 472 of spindle hub 147, and a forwardly reaching neck 427 defined by the distal lateral pin 428. As seen in FIGS. 8 and 10 retraction lever 142 may be formed with pivot arms 422 integrally joined to flat central section 426, the central section 426 being extended on one side to lifter arm 425 and on to neck 427. The flat central section 426 remains accessible to the extension 163 at the bottom of the combined casing halves 148, 149. The pivot arms 422 of retraction lever 142 are carried on screw stem 487 as seen in FIG. 1(B), and a torsion spring 223 is also carried on the screw stem 487 between the pivot arms 422 of the retraction lever 142 as seen in FIG. 9 to bias it downward to its home position.

The bolt 146 of FIG. 1A, as seen in FIG. 1B, further comprises a bolt head 240 having a tail 250 defined by the ramped aperture 254. The bolt 146 may be formed as a unitary component or discrete interfitting components. For purposes of illustration the depicted bolt 146 comprises a discrete bolt head 240 that removably mates with a discrete tail 250, though this detachment ability is optional.

Figure 13:
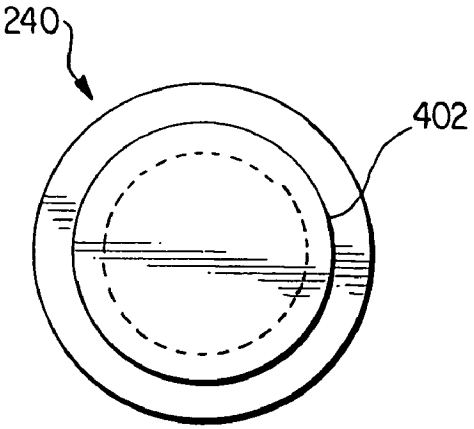
FIGS. 11-13 are a bottom view, side view and end view, respectively, of bolt head 240 of bolt 146 of FIG. 1B.
Figure 11:
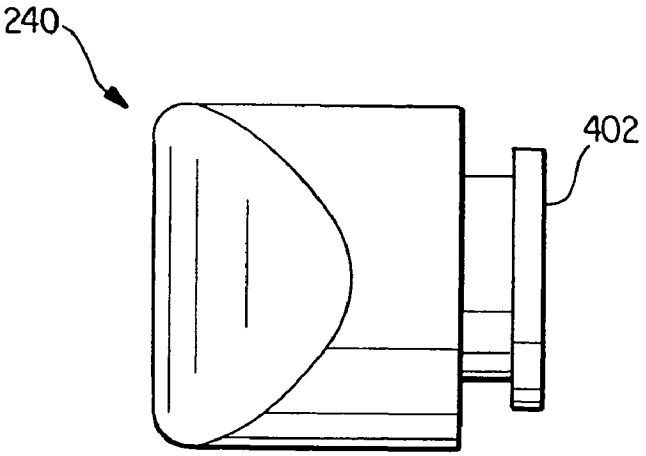
Figure 12:
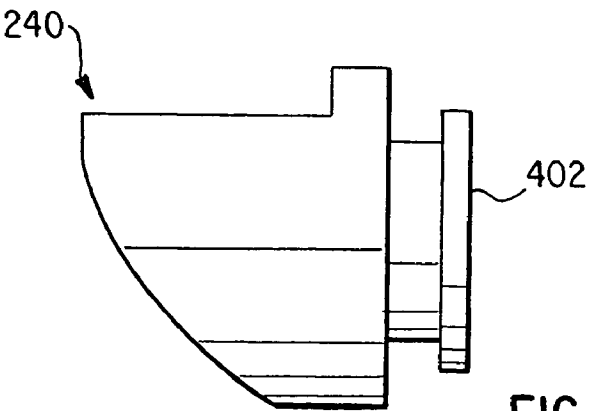

FIGS. 11-13 are a bottom view, side view and end view, respectively, of bolt head 240 of bolt 146 of FIG. 1B. The bolt head 240 includes a standard bolt face for slidable engagement with a plate installed in a doorjamb in a conventional manner. However, in this case the bolt face is formed with a rearwardly protruding stem 402 having a circular annular flange for insertion in a receptacle in the tail attachment 250.

Figure 16:
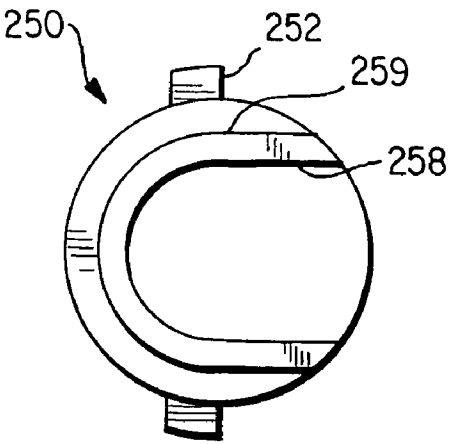
FIGS. 14-16 are a side view, top view and front end view, respectively, of the ramp attachment 250 of bolt 146 of FIG. 1B.
Figure 14:
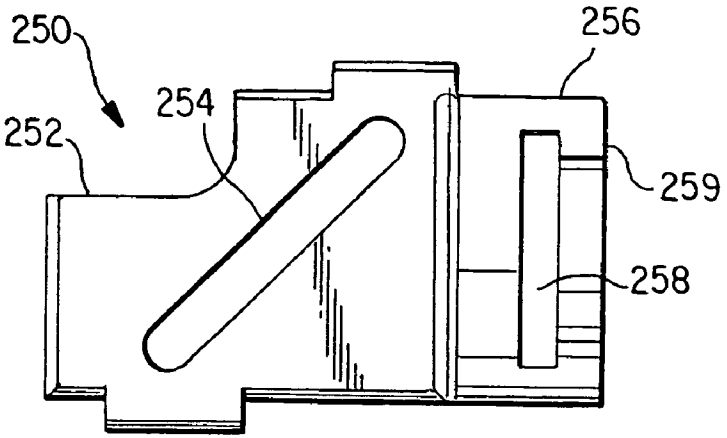
Figure 15:
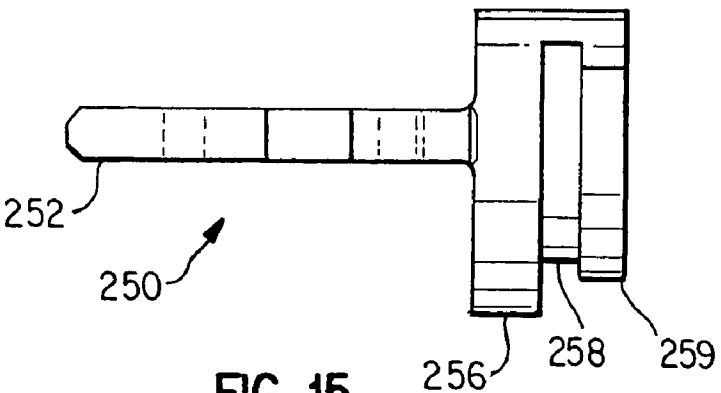

FIGS. 14-16 are a side view, top view and front end view, respectively, of the tail attachment 250 of bolt 146 of FIG. 1B. The tail attachment 250 comprises a T-shaped member as seen in FIG. 15 having an annular stirrup 256 for releasably anchoring the stem 402 of bolt head 240. The stirrup 256 is formed as an annular member with an inner annular open-topped notch 258 that leads outward past lips 259 for slidable insertion of the stem 402 of bolt head 240. The lips 259 form a radial flange around the stem 402 for holding it captive therein. The stem 402 can be easily removed by lifting it out of the notch 258, but when inserted essentially lock the bolt head 240 and ramp attachment 250*m* together in one integral bolt 146.

The stirrup 256 is integrally joined (orthogonally) with a flat slide plate 252 defined by the ramped aperture 254. The pin 428 of neck 427 of lever 142 traverses the aperture 254 and as the lever 142 pivots the neck 427 up and down, this urges the slide plate 252 (vis a vis pin in notch 254) backward and forward. This effectively moves the bolt head 240 in and out of engagement with the plate installed in the doorjamb to unlatch the door.

Figure 18:
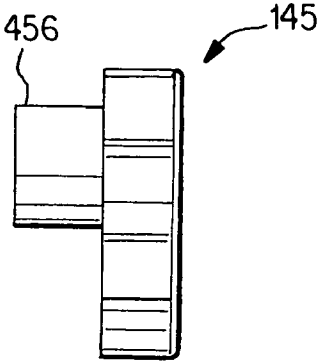
FIGS. 17-18 are a side view and end view, respectively, of the reversing lever 145 of FIG. 1B.
Figure 17:
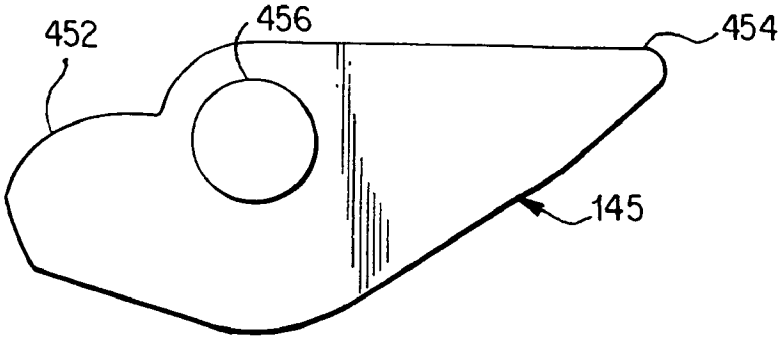

FIGS. 17-18 are a side view and end view, respectively, of the reversing lever 145 of FIG. 1B. Reversing lever 145 generally comprises a protruding pin 456 attached to an eccentric member with a cam surface 452 on one side and an extended lift arm 454 on the other. As seen in FIG. 5 the reversing lever 145 is pivotally seated by pin 456 in the pivot hole 497 of the left side casing 149. The cam surface 452 is exposed rearwardly for engagement with the spindle hub 147, while the lift arm 454 protrudes forwardly through the retraction lever 142 for engaging the pin 428 of lever 142 and pivoting it. Thus, when the spindle hub 147 rotates counterclockwise the inner cam surface 472 (closest to the retraction lever 142) will bear upward against the lifter arm 425 of retraction lever 142, thereby lifting retraction lever 142. This in turn urges the tail 252 of the bolt 146 (vis a vis pin in aperture 254) backward. This in turn moves the bolt head 240 in and out of engagement with the plate installed in the door jamb to unlatch the door.

Figure 20:
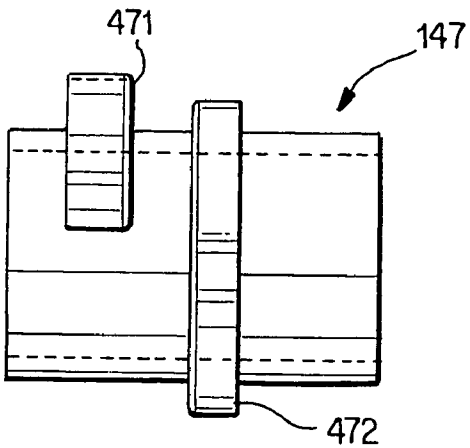
FIGS. 19-20 are a side view and front view, respectively, of the spindle hub 147 of FIG. 1B.
Figure 19:
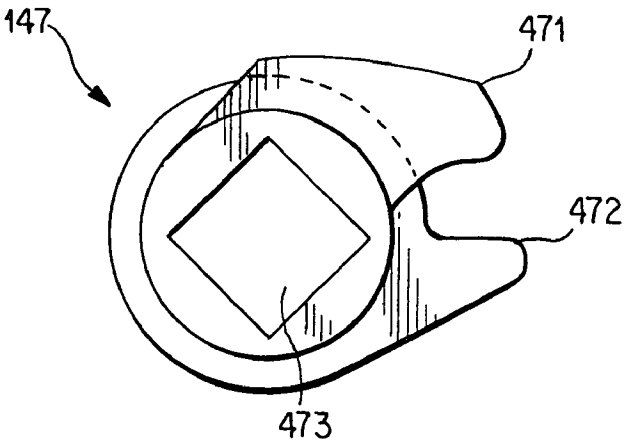

FIGS. 19-20 are a side view and front view, respectively, of the spindle hub 147 of FIG. 1B. The spindle hub 147 comprises a bushing that is rotatably seated in the central apertures 488, 498 of the right and left side casings 148, 149, respectively. The spindle hub 147 is a generally annular member with a pair of radially-protruding cams 471, 472. The two cams 471, 472 are offset axially as seen in FIG. 20. When the spindle hub 147 is rotated clockwise cam 471 engages one end of reversing lever 145, which pivots, and the extended lift arm 454 at the other end of reversing lever 145 engages the lateral pin 428 of the retraction lever 142 (see FIGS. 8 and 9). This lifts the retraction lever 142, which cams the bolt 146 back so that it retracts into the case formed by halves 148, 149, thereby allowing the door to open. Conversely, when the spindle hub 147 rotates counterclockwise the inner cam surface 472 does the work, bearing upward against the lug of lifter arm 425 on the retraction lever 142, lifting retraction lever 142, and retracting the bolt 146 to unlatch the door.

The retraction lever 142 is engaged from beneath by extension 163 (see FIG. 1B), which enters the escutcheon from thumbpiece 161 outside the door and gains access to the retraction lever 142 at the bottom of the casing halves 148, 149. Thus, depressing the thumbpiece 161 raises the extension 163 against the retraction lever 142 at the bottom of the casing halves 148, 149, thereby Bearing upward against the floor 426 of retraction lever 142, pivoting the retraction lever 142 and moving the lateral pin 428 at its forward end upward along the ramped side of aperture 254 formed in the bolt 146. This in turn cams the bolt 146 backward so that it retracts into the case 148, allowing the door to open.

In summary of the functioning of the above-described components, FIG. 21 (A-D) is a composite sequential illustration of the operation of the central latch subassembly 140.

Figure 21A:
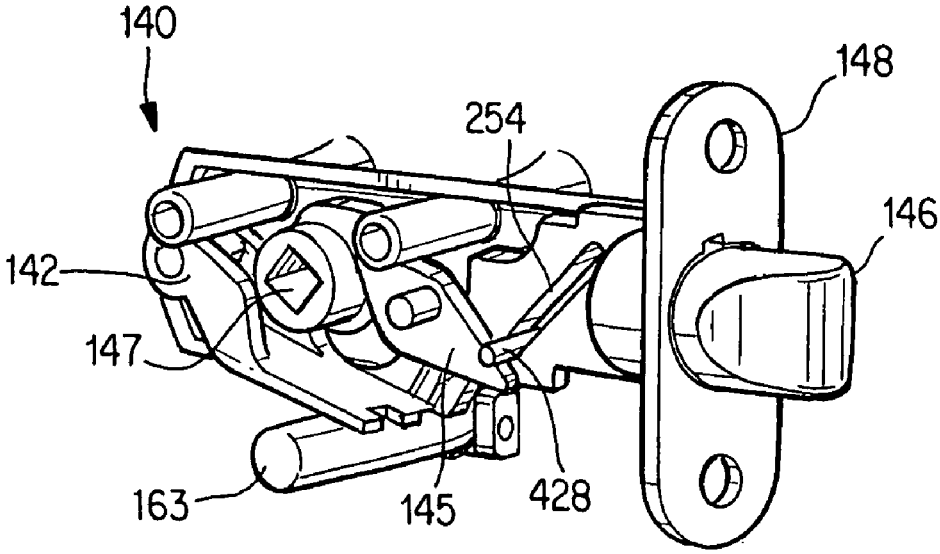
FIG. 21 (A-D) is a composite sequential illustration of the operation of the central latch subassembly 140.

At FIG. 21(A), the central latch subassembly 140 is in a neutral position with pin 428 at the bottom of aperture 254 and bolt 146 therefore fully extended.

Figure 21B:
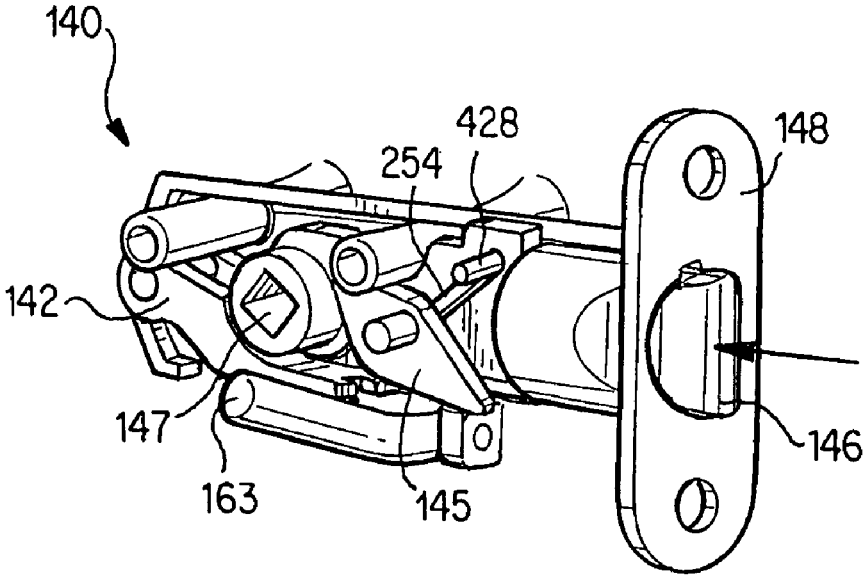

As seen at FIG. 21(B), depressing the thumbpiece of FIG. 1A raises the thumbpiece extension 163 which bears against the bottom of retraction lever 142 and pushes it upward. This pivots the retraction lever 142 and moves the lateral pin 428 at its forward end upward along the ramped aperture 254 formed in the bolt 146. This in turn cams the bolt 146 backward so that it retracts into the case 148 allowing the door to open. Operation of the thumbpiece is entirely independent of the spindle hub 147.

Latch retraction is also accomplished from inside the door by turning a knob or lever to turn the spindle hub 147, which operates counterclockwise through the retraction lever 142 to retract the latch bolt 146, and clockwise through the reversing lever 145 to do the same, both of these operation being described in more detail below. In either case the thumbpiece is not affected.

Figure 21C:
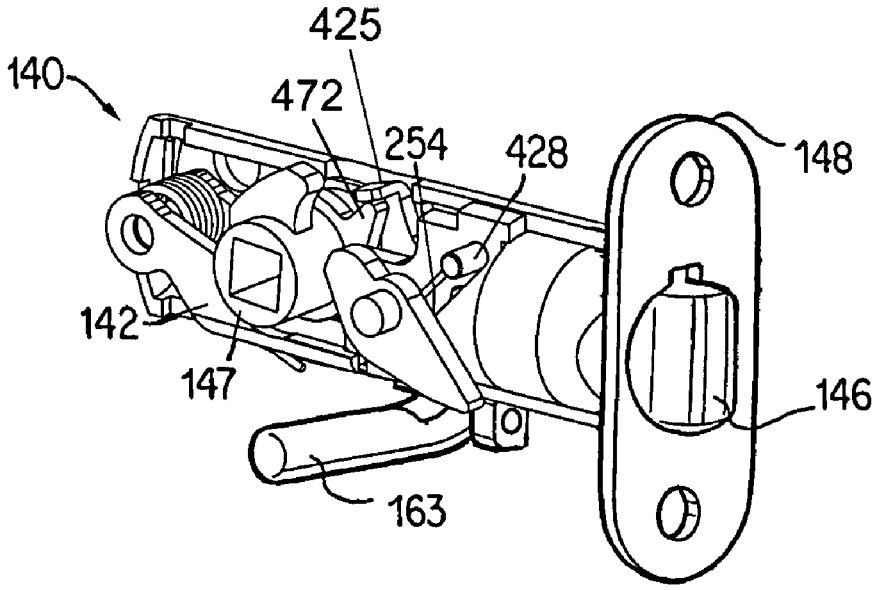

The foregoing is best seen in FIG. 21(C), which illustrates the latch subassembly 140 with reversing lever 145 removed for illustration. When spindle hub 147 is turned counterclockwise, the inner cam surface 472 (see FIG. 20) of spindle hub 147 bears against the lifter arm 425 of retraction lever 142, thereby pivoting the retraction lever 142 and moving the lateral pin 428 at its forward end upward along the ramped aperture 254 formed in the bolt 146. This in turn cams the bolt 146 backward so that it retracts into the case 148 allowing the door to open.

Figure 21D:
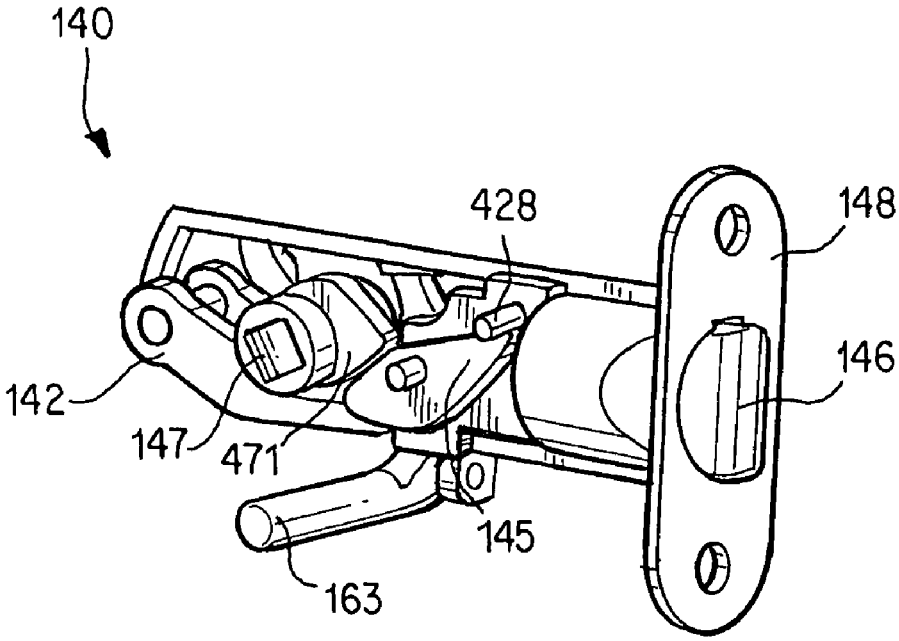
Figure 22:
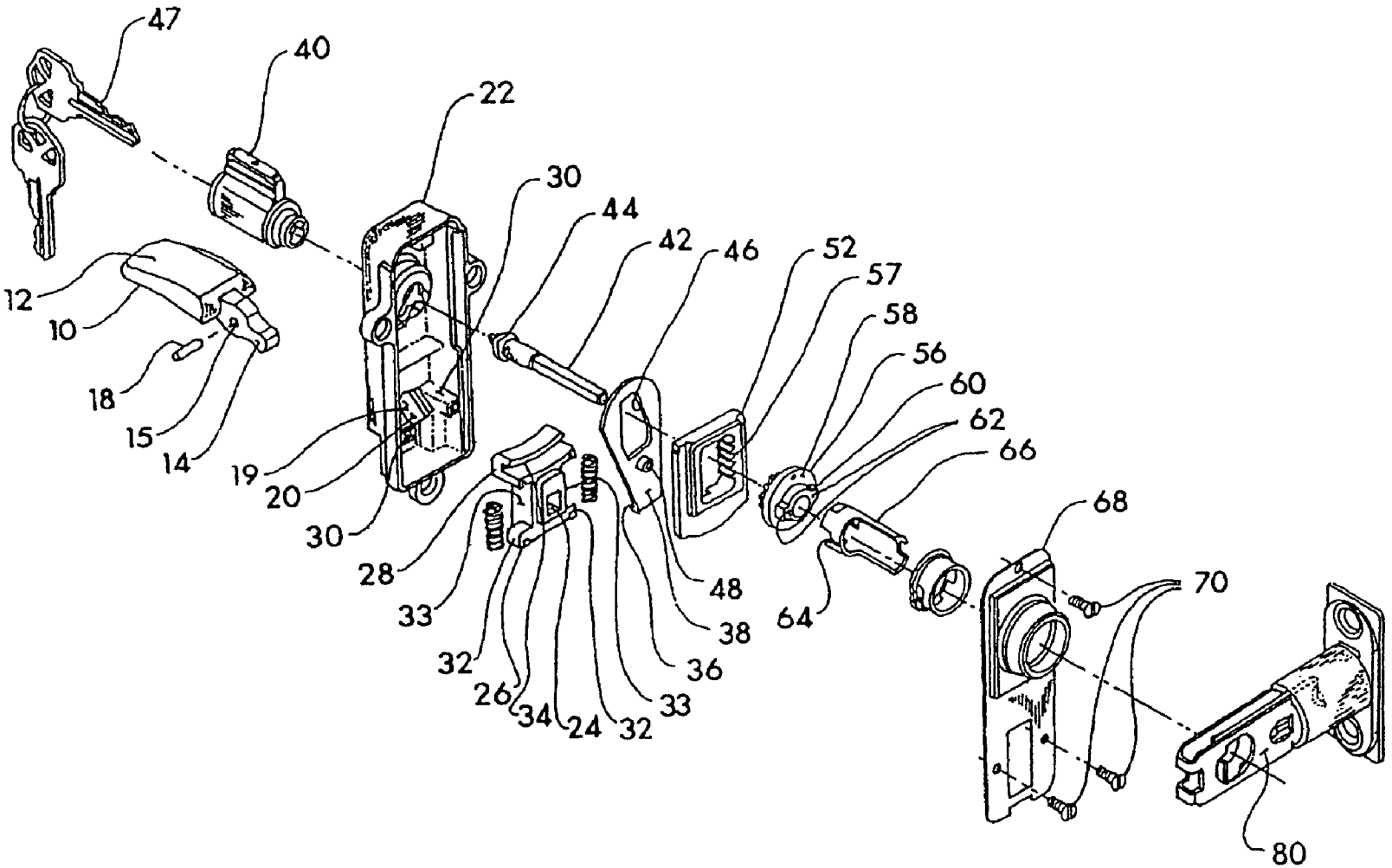
FIG. 22 PRIOR ART
FIG. 22 is a prior art illustration from U.S. Pat. No. 5,513,510 to Solovieff et al. showing an exemplary handleset with thumbpiece and rack that requires a motion translation mechanism.

Conversely, as seen in FIG. 21(D), when the spindle hub 147 is operated in the clockwise direction, the outer cam surface 471 (see FIG. 20) engages the proximate end of reversing lever 145, which then pivots. The extended lift arm on the other end of reversing lever 145 engages the lateral post 428 of the retraction lever 142, lifting the retraction lever 142 and camming the bolt 146 backward. In both cases where the spindle hub 147 is operated the thumbpiece extension 163 (and hence thumbpiece 161) is not affected.

One skilled in the art will now see that the foregoing configuration provides direct operation of the latch by the thumbpiece 161. This entirely eliminates any need for off-axis rotary motion translation (by gears as in FIG. 21 or other mechanisms) as ordinarily used to adapt the axis of rotation of thumbpiece 161 to the orthogonal axis of rotation of spindle hub 147. This reduces the total number of parts as well as the internal friction normally associated with the motion translator, thereby providing smoother operation and reduced wear cost.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A latch assembly, comprising: a tubular latch casing for mounting within a door; a bolt mounted in said latch casing for extension and retraction along a longitudinal axis to thereby latch said door along said longitudinal axis; a retraction lever mounted in said latch casing and coupled to the bolt and disposed for pivoting about a first pivot axis perpendicular to the longitudinal axis to retract the bolt; an operator for mounting to a face of the door and disposed for pivoting about a second pivot axis parallel to the longitudinal axis, the retraction lever pivoting about the first pivot axis in response to the operator pivoting about the second pivot axis; a spindle hub mounted in the latch casing, the spindle hub engaging the retraction lever to retract the bolt upon rotation of the spindle hub in a first direction; a reversing lever mounted in the latch casing, the spindle hub engaging the retraction lever to retract the bolt via the reversing lever upon rotation of the spindle hub in an opposite direction.

2. The latch assembly of claim 1, wherein the spindle hub includes a first cam surface and a second cam surface, the first cam surface engaging the retraction lever to retract the bolt and the second cam surface engaging the retraction lever via the reversing lever to retract the bolt.

3. A latch assembly, comprising: a tubular latch casing for mounting within a door having a first axis, a second axis, and a third axis, the first axis being perpendicular to the second axis and the third axis; a bolt mounted in said latch casing for extension and retraction along the first axis to thereby latch said door along said longitudinal axis; a retraction lever mounted in said latch casing and coupled to the bolt and pivoting about the second axis for retracting the bolt; a reversing lever mounted in said latch casing and pivoting about the third axis and engaging the retraction lever to retract the bolt; and a spindle hub mounted within the latch casing and operated by an operator, said spindle hub having a first cam surface and a second cam surface, the retracting lever engaged by the first cam surface and pivoting about the second axis in response to rotation of the spindle hub in a first direction and the reversing lever engaged by the second cam surface and pivoting about the third axis in response to rotation of the spindle hub on a second direction.

4. The latch assembly of claim 3 wherein said operator is mounted to a face of the door and configured to pivot about a fourth axis parallel to the first axis, the retracting lever engaged by the operator and pivoting about the second axis in response to the pivoting of the operator about said fourth axis.

5. A latch assembly, comprising: a tubular latch casing for mounting within a door; a bolt mounted in said latch casing for extension and retraction along a first axis to thereby latch said door along said longitudinal axis; a retraction lever mounted in said latch casing; a reversing lever mounted in said latch casing for retracting the bolt by engaging the retraction lever; a spindle hub rotatably mounted in said latch casing and including a first cam surface for engaging the retraction lever and a second cam surface for engaging the reversing lever; a first operator for mounting to a face of the door and disposed for pivoting about a second axis perpendicular to the first axis, said first operator coupled to, and coaxial with the spindle hub, the retraction lever engaged by the first operator via the spindle hub and retracting the bolt in response to the first operator pivoting about the second axis; and a second operator for mounting to another face of the door and disposed for pivoting about a third axis parallel to the first axis, the retraction lever engaged by the second operator and retracting the bolt in response to the second operator pivoting about the third axis.

6. The latch assembly of claim 5 wherein the first cam surface engages the retraction lever in response to rotation of the first operator in a first direction and the second cam surface engages the reversing lever in response to rotation of the first operator in a second direction, thereby retracting the bolt.

7. The latch assembly of claim 5 wherein the retraction lever is pivotable about a first pivot axis perpendicular to the first axis.

8. The latch assembly of claim 5 wherein the reversing lever is pivotable about a second pivot axis perpendicular to the first axis.

9. The latch assembly of claim 5 wherein the bolt further comprises a tail portion having an elongated slot formed at an angle to the first axis and the retraction lever further comprises a pin disposed in the slot such that rotation of the retraction lever laterally translates the pin in the slot causing the bolt to retract.

10. The latch assembly of claim 5 wherein the retraction lever is mounted at a first end of said casing extending toward and engaging a distal end of the bolt mounted at an opposite end of the casing, the spindle hub is mounted between the retraction lever mounting point and the distal end of the bolt and the reversing lever is mounted between the spindle hub and the bolt.

11. A method of retracting a latch disposed in a latch casing comprising the steps of: providing a tubular latch casing for mounting within a door; providing a bolt mounted in said latch casing for extension and retraction along a longitudinal axis to thereby latch said door along said longitudinal axis; providing a retraction lever pivotally mounted in the latch casing for pivoting about a first axis perpendicular to the longitudinal axis to retract the bolt; providing a reversing lever pivotally mounted in the latch casing, providing a spindle hub within the latch casing including a first cam surface for engaging the retraction lever to retract the bolt and a second cam surface for engaging the retraction lever via the reversing lever to retract the bolt; providing a first operator mounted to a face of the door and coupled to the spindle hub, the spindle hub engaging the retraction lever in response to rotation of the first operator in a first direction and the spindle hub engaging the retraction lever via the reversing lever in response to rotation of the first operator in a second direction.

12. The method of claim 11 further including the step of providing a second operator for mounting to a face of the door and pivotable about a second pivot axis parallel to the longitudinal axis of the bolt, the retraction lever retracting the bolt in response to pivotal movement of the second operator.

* * * * *